343-700 MS AU 251 EX
10/20/87 OR 4,701,763

United States Patent [19]
Yamamoto et al.

[11] Patent Number: 4,701,763
[45] Date of Patent: Oct. 20, 1987

[54] SMALL ANTENNA

[75] Inventors: Junko Yamamoto, Okayama; Kyohei Fujimoto; Kazuhiro Hirasawa, both of Niihari; Haruhiro Kuboyama, Tsuchiura, all of Japan

[73] Assignee: Matsushita Electric Industrial Co., Ltd., Kadoma, Japan

[21] Appl. No.: 776,529

[22] Filed: Sep. 16, 1985

[30] Foreign Application Priority Data

Sep. 17, 1984 [JP] Japan ..... 59-194232

[51] Int. Cl.[4] ..... H01Q 1/38; H01Q 1/48
[52] U.S. Cl. ..... 343/700 MS; 333/236; 333/248; 343/702; 343/772; 343/908
[58] Field of Search .... 343/700 R, 700 MS, 772–775, 343/702, 705, 829–830, 907, 893, 908; 333/236, 238, 239, 245–248

[56] References Cited

U.S. PATENT DOCUMENTS 4,197,544 4/1980 Kaloi ..... 343/700 MS

*Primary Examiner*—Marvin L. Nussbaum
*Attorney, Agent, or Firm*—Wenderoth, Lind & Ponack

[57] ABSTRACT

A small antenna including a dielectric plate, upper and lower conductive plates provided on upper and lower faces of the dielectric plate, respectively, a plurality of conductive reactance posts for connecting, at first positions of the dielectric plate, the upper and lower conductive plates to each other, and a feed point provided at a second position of the dielectric plate such that first and second plane-parallel plate transmission lines separated from each other by the reactance posts are formed by the upper and lower conductive plates.

13 Claims, 15 Drawing Figures

SMALL ANTENNA

BACKGROUND OF THE INVENTION

The present invention generally relates to antennas and more particularly, to a small antenna to be accommodated in small-sized communication appliances such as a paging apparatus, a portable wireless apparatus, etc.

Conventionally, in built-in small antennas of small-sized wireless apparatuses, etc., it has been generally so arranged as shown in FIG. 1 that a loop antenna 2 is accommodated in a casing 1. However, the loop antenna 2 has such drawbacks that when a printed circuit board 3 or a circuit component 4 is provided so adjacent to the loop antenna 2 as to come close to the antenna element, the antenna gain decreases and the impedance varies. Meanwhile, in the case where the operator attaches the casing 1 to his pocket or the like by using a clip 5, characteristics of the loop antenna 2 undesirably deteriorate sharply in the vicinity of the operator.

SUMMARY OF THE INVENTION

Accordingly, an essential object of the present invention is to provide a small antenna having a high gain, which is so compact in size as to be incorporated in a casing of a small-sized electronic appliance such as a portable wireless apparatus or the like, with substantial elimination of the disadvantages inherent in conventional small antennas of this kind.

Another important object of the present invention is to provide a small antenna of the above described type whose sensitivity drop is minimal even if an operator uses the antenna by attaching to his chest pocket or the like the casing having the antenna accommodated therein.

Still another object of the present invention is to provide a small antenna of the above described type whose sensitivity drop caused by other electronic components accommodated in the casing is minimal.

A further object of the present invention is to provide a small antenna of the above described type in which when a transmitting or receiving circuit of the wireless apparatus is connected to a feed point of the antenna, impedance matching between the antenna and the circuit can be performed easily.

In order to accomplish these objects of the present invention, a small antenna embodying the present invention comprises a dielectric member; an upper conductive plate which is provided on an upper face of said dielectric member; a lower conductive plate which is provided on a lower face of said dielectric member; said upper and lower conductive plates extending in parallel with each other so as to interpose therebetween said dielectric member; a plurality of reactance posts which are provided at a first position of said dielectric member so as to connect said upper conductive plate and said lower conductive plate and divide said upper and lower conductive plates into a first upper conductive portion and a second upper conductive portion and into a first lower conductive portion and a second lower conductive portion, respectively such that first and second parallel-plate transmission lines are, respectively, formed by said first upper conductive portion and said first lower conductive portion and by said second upper conductive portion and said second lower conductive portion; and a feed point which is provided at a second position of said dielectric plate. Thus, in the antenna of the present invention, two antenna apertures are formed at opposite ends of the first and second parallel-plate transmission lines and are subjected to excitation such that the antenna acts as a magnetic-current antenna.

Consequently, in accordance with the present invention, it becomes possible to increase antenna gain through excitation of the two antenna apertures.

Furthermore, in accordance with the present invention, drop of antenna gain in the vicinity of the operator carrying the antenna is minimized and the antenna has a relatively excellent directivity in all directions.

Moreover, in accordance with the present invention, the antenna itself can be formed remarkably thin.

In addition, in accordance with the present invention, since the antenna can be provided separately from the circuit portions by ground-plane effect of the conductive plates in the case where the antenna is mounted on the casing, etc., it becomes possible to eliminate proximity effect of the components and the antenna can be suitably used as a built-in antenna for a compact portable wireless apparatus, etc.

BRIEF DESCRIPTION OF THE DRAWINGS

These objects and features of the present invention will become apparent from the following description taken in conjunction with the preferred embodiments thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
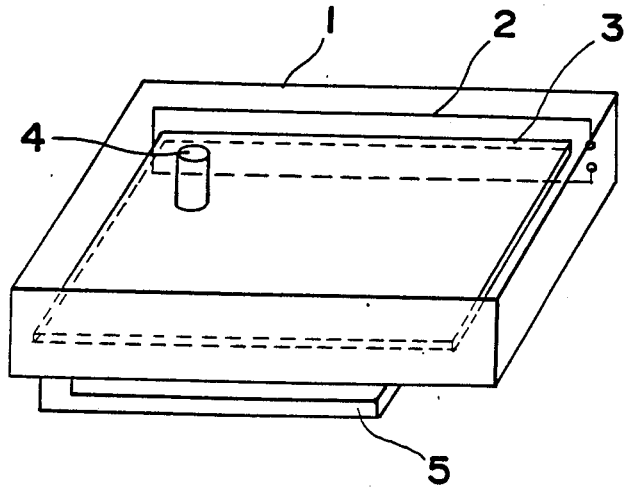
Fig. 1 PRIOR ART
FIG. 1 is a perspective view of a prior art miniaturized antenna (already referred to)
Figure 2:
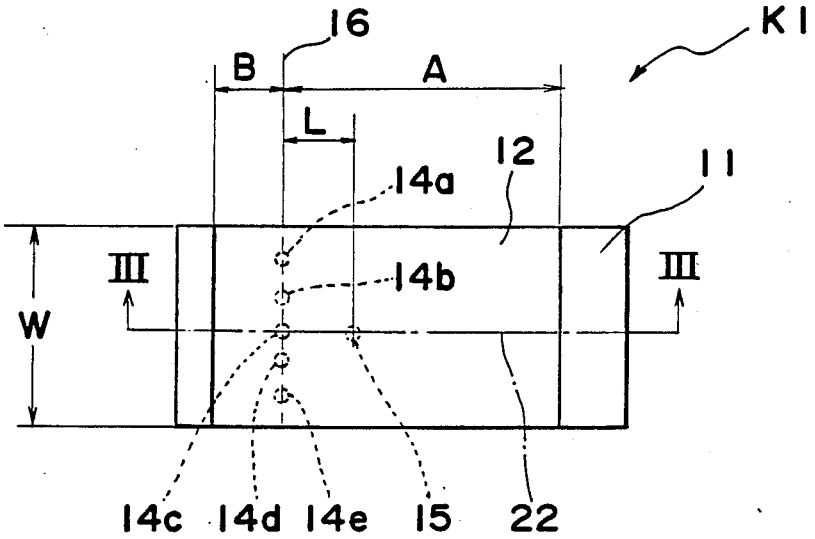
FIG. 2 is a top plan view of a small antenna according to a first embodiment of the present invention.
Figure 3:
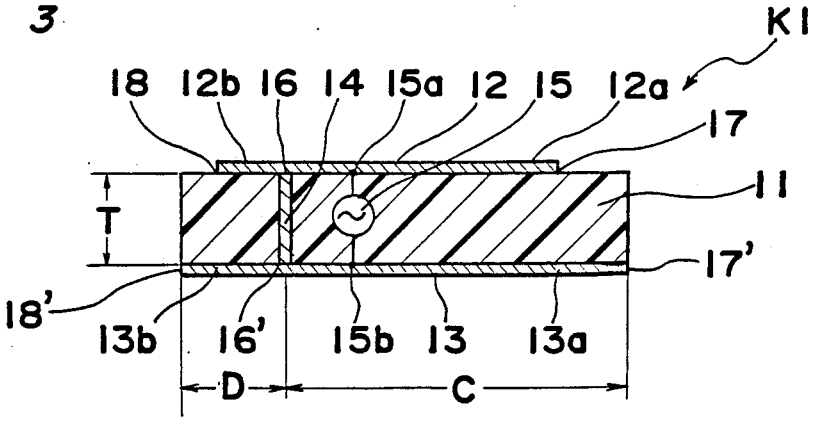
FIG. 3 is a cross-sectional view taken along the line III—III in FIG. 2.

Referring now to the drawings, there is shown in FIGS. 2 and 3, a small antenna K1 according to a first embodiment of the present invention. The antenna K1 includes a rectangular dielectric plate 11, a rectangular platelike upper element 12 bonded to an upper face of the dielectric plate 11, and a rectangular platelike lower element 13 bonded to a lower face of the dielectric plate 11. The dielectric plate 11 having an effective dielectric constant $\epsilon$ is made of, for example, polytetrafluoroethylene (PTFE) subjected to low dielectric loss in a high-frequency band and is of a thickness far smaller than a wavelength corresponding to a frequency utilized by the antenna K1. Meanwhile, the upper and lower elements 12 and 13 are made of electrically conductive material. The lower element 13 having opposite ends 17' and 18' is of a length and a width identical with those of the dielectric plate 11. On the other hand, the upper element 12 having opposite ends 17 and 18 is of the same width as that of the dielectric plate 11 but is of a length slightly smaller than that of the dielectric plate 11. It can also be so arranged that the dielectric plate 11, the upper element 12 and the lower element 13 are simultaneously formed by machining a double-sided printed circuit board. It can also be further so arranged that the upper element 12 is formed larger, in length, than the lower element 13.

The antenna K1 further includes a plurality of reactance posts 14 formed by a plurality of postlike conductor wires 14*a*, 14*b*, 14*c*, 14*d* and 14*e* which are, respectively, disposed at a plurality of first positions of the dielectric plate 11 so as to connect the upper and lower plates 12 and 13 to each other. In this embodiment, the reactance posts 14 are disposed at a plurality of positions spaced at regular intervals along a line 16 extending in a widthwise direction of the upper element 12 such that a point on the line 16 and an opposite point on a line 16' disposed, immediately below the line 16, on the lower element 13 are connected to each other by each of the reactance posts 14.

Furthermore, the antenna K1 includes a feed point 15 for the antenna K1, which is provided at a second position of the dielectric plate 11 so as to be disposed between the upper and lower elements 12 and 13. The feed point 15 is located at a longitudinal centerline 22 of the dielectric plate 11. The feed point 15 is connected to an output port of a transmitting circuit of a wireless apparatus (not shown), an input port of a receiving circuit of the wireless apparatus or the like. Since these transmitting and receiving circuits are usually arranged to have a source impedance of 50 Ω or a load impedance of 50 Ω, it becomes possible to effect power feed to the antenna K1 without matching loss by setting a feed-point impedance of the antenna K1 at 50 Ω.

The upper element 12 is divided by the line 16 into rightward and leftward portions, i.e., a first conductor portion 12*a* having a length A and a second conductor portion 12*b* having a length B. Similarly, the lower element 13 is divided by the line 16' corresponding to the line 16 of the upper element 12 into rightward and leftward portions, i.e., a third conductor portion 13*a* having a length C and a fourth conductor portion 13*b* having a length D. The dielectric plate 11 and the upper and lower elements 12 and 13 have a width W and the dielectric plate 11 has a thickness T. The feed point 15 is disposed between a point 15*a*on the upper element 12 and a point 15*b* on the lower element 13. Furthermore, the feed point 15 is spaced a distance L from the line 16.

The above described dimensions A to D, W, T and L are determined as follows. Since the antenna K1 is usually accommodated in a casing (not shown) of the wireless apparatus, the upper and lower elements 12 and 13 are restricted in the dimensions. Meanwhile, since a printed circuit board, circuit components, etc. are usually accommodated, below the lower element 13, in the casing of the wireless apparatus, it is inevitably necessary to set the thickness T of the dielectric plate 11 at an extremely small value as compared with the wavelength. In the case where the thickness T is far smaller than the wavelength corresponding to the frequency utilized by the antenna K1, the antenna gain improves as the value of the thickness T is increased. Furthermore, a first plane-parallel plate transmission line having a characteristic impedance $Z_1$ is formed by the first conductor portion 12*a* an the third conductor portion 13*a* interposing the dielectric plate 11 therebetween. Thus, supposing that character λ represents the wavelength, the length A of the first conductor portion 12*a* of the upper element 12 is set at about $(\frac{1}{4})\lambda$ corresponding to the resonant length. Assuming that character V represents velocity of light, character f represents the frequency utilized by the antenna K1 and character N represents an odd number of 1 or more, the length A is approximately expressed by the following equation.

$$A \approx \frac{1}{4} \times V/f \times 1/\sqrt{\epsilon} \times N \quad (1)$$

Figure 6:
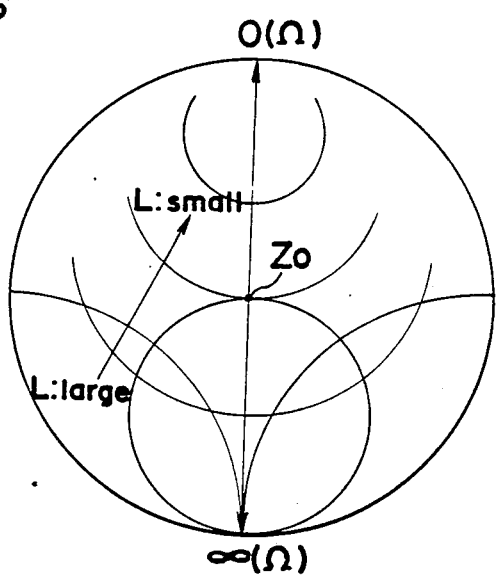
FIG. 6 is a Smith chart explanatory of impedance matching of the antenna of FIG. 2.

Meanwhile, a second plane-parallel transmission line having a characteristic impedance $Z_2$ is formed by the second conductor portion 12*b* of the upper element 12 and the fourth conductor portion 13*b* of the lower element 13. The length B of the second conductor portion 12*b* of the upper element 12 contributes towards improvement of the antenna gain as will be described later and is determined experimentally in consideration of impedance matching and the antenna gain. The feed point 15 is usually disposed at such a position as to produce the feed-point impedance of 50 Ω. In this connection, in a Smith chart of FIG. 6 having a normalized impedance $Z_0$, frequency characteristic of the feed-point impedance is plotted by employing the distance L as a parameter. It will be seen from FIG. 6 that as the feed point 15 is further spaced away from the line 16, namely as the distance L is increased, the feed-point impedance increases. Meanwhile, if the width W of the upper and lower elements 12 and 13 is not more than $(\frac{1}{4})\lambda$, the antenna gain improves as the width W is increased. When the dimensions A to D, W, T and L are set by way of example in such a manner as A=50 mm, B=17 mm, C=53 mm, D=22 mm, W=30 mm, T=1.2 mm and L=6 mm in a frequency band at 900 MHz, a relative dielectric constant $\epsilon_\gamma$ of about 2.6 is obtained. It is possible to secure the reactance posts 14*a* to 14*e*, etc. efficiently and fixedly by employing a through-hole method for the printed circuit board.

Figure 4:
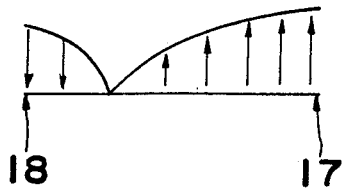
FIG. 4 is a diagram explanatory of potential distribution of the antenna of FIG. 2.

Hereinbelow, operations of the antenna K1 of the above described arrangement of FIGS. 2 and 3 will be described. Since the upper element 12 is provided excessively adjacent to the lower element 13, the antenna K1 fundamentally acts as a kind of a magnetic-current antenna. As shown in FIG. 4, the antenna K1 is driven such that potentials expressed by vertical amplitudes assume a maximum value at one end 17 of the upper element 12. At this time, the first plane-parallel plate transmission line is formed by the first conductor portion 12*a* and the third conductor portion 13*a* and the second plane-parallel plate transmission line is formed by the second conductor portion 12*b* and the fourth conductor portion 13*b* such that the reactance posts 14 formed, as an inductance, by the short conductors 14*a* to 14*e* are loaded on the first and second plane-parallel plate transmission lines connected in parallel with each other, respectively. Opposite edge portions of the dielectric plate 11, which are, respectively, disposed between the end 17 of the upper element 12 and the end 17' of the lower element 13 and between the end 18 of the upper element 12 and the end 18' of the lower element 13, act as an antenna aperture of magnetic current.

The length A of the fist conductor portion 12a is set at a value of about the quarter wavelength corresponding to the frequency utilized by the antenna K1. In order to obtain a maximum antenna gain, it is desirable to make the length B of the second conductor portion 12b as large as possible if the size of the casing of the wireless apparatus permits. Meanwhile, it is possible to effectively reduce the length B of the second conductor portion 12b by the effect of the reactance posts 14.

Figure 7:
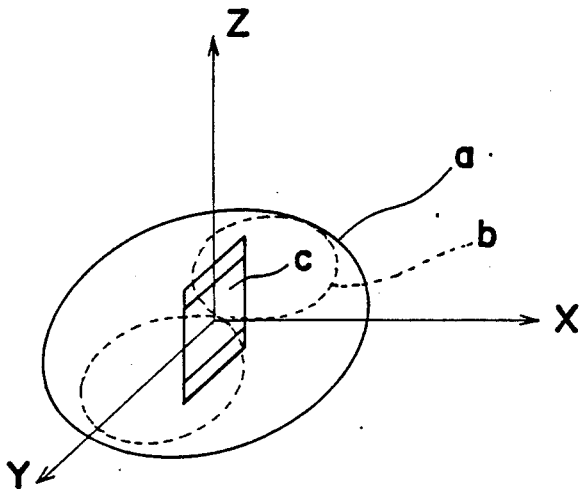
FIG. 7 is a directivity diagram of the antenna of FIG. 2 placed in free space.

The antenna K1 of the above described arrangement has such directivity in free space as shown in FIG. 7. Namely, with respect to a mounting direction c of the antenna face oriented in the Y-axis, the antenna K1 has a directivity a for a vertically polarized wave and a directivity b for a horizontally polarized wave in the horizontal plane (X-Y plane). Thus, the antenna K1 is non-directional for the vertically polarized wave but possesses, for the horizontally polarized wave, a directional characteristic of figure-8 pattern having a maximum in the direction of the Y-axis.

Figure 5:
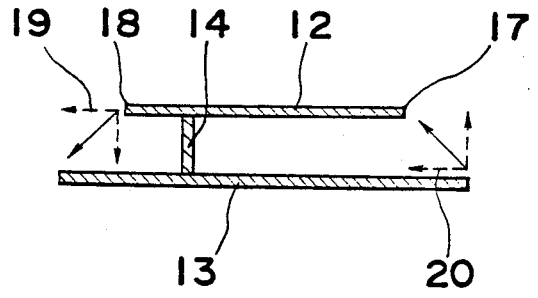
FIG. 5 is a view similar to FIG. 3, explanatory of gain of the antenna of FIG. 2.

More specifically, as shown in FIG. 5, vertical components 19 and 20 of electric field distribution existing between the upper and lower elements 12 and 13, in the case of the vertically polarized wave, which are spaced far from each other, contribute, in combination, towards improvement of the antenna gain of the antenna K1. It was found that a measured antenna gain of the antenna K1 having the above described dimensions, i.e., A=50 mm, B=17 mm, C=53 mm, D=22 mm, W=30 mm, T=1.2 mm and L=6 mm assumes (half wavelength dipole ratio −4 dB).

Figure 10A:
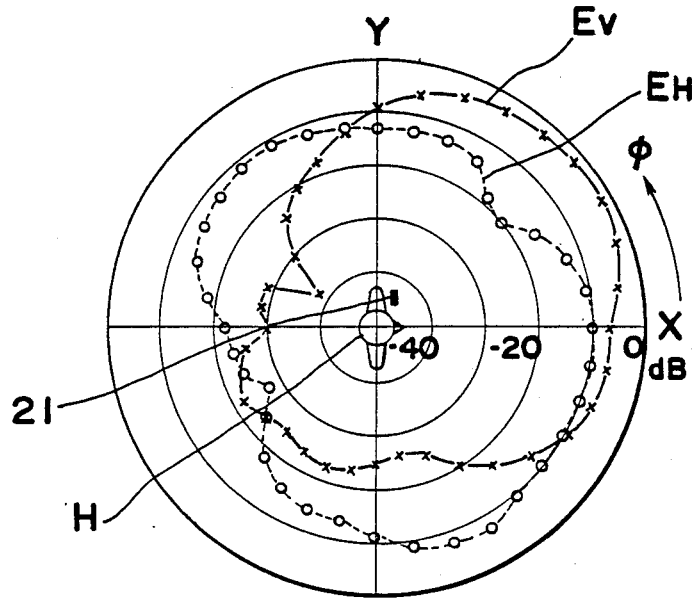
FIGS. 10*a* and 10*b* are directivity diagrams of the antenna of FIG. 2 attached to an operator.
Figure 10B:
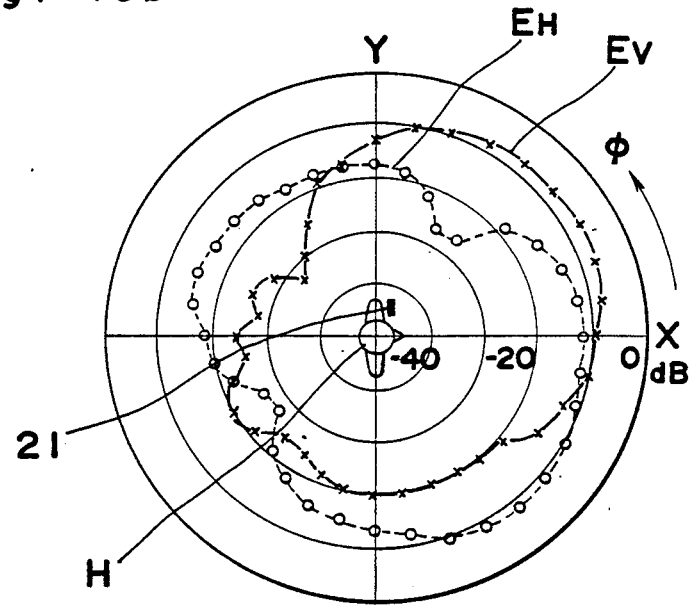

Then, measurements of the antenna gain of the antenna K1 at the time when the antenna K1 is attached to the operator H will be described with reference to FIGS. 10a and 10b showing measured directivity of the antenna K1 for a vertically polarized wave $E_v$ and a horizontally polarized wave $E_H$. In FIGS. 10a and 10b, a casing 21 having the antenna K1 accommodated therein is attached to the waist of the operator H such that the upper element 12 faces in the direction remote from the operator H. The length B of the second conductor portion 12b is set at 17 mm in FIG. 10a but is set at 0 mm in FIG. 10b. It will be readily understood that the antenna gain of the antenna K1 of FIG. 10a is larger than that of FIG. 10b on the average. Namely, in the above described arrangement of the antenna k1, since the first and second conductor portions 12a and 12b, which are oriented in opposite directions with respect to the reactance posts 14 and are connected in parallel with each other, form the first and second transmission lines such that magnetic current is radiated from the antenna aperture disposed at the opposite end portions of the upper element 12, it was found that even if the antenna K1 is attached to the operator H, the antenna gain of the antenna K1 exhibits no drop by assuming (half-wavelength dipole ratio −4~2) dB). Meanwhile, by a ground-plane effect of the upper and lower elements 12 and 13, variations in impedance of the antenna K1 decrease and thus, it is possible to easily effect impedance matching.

Figure 8:
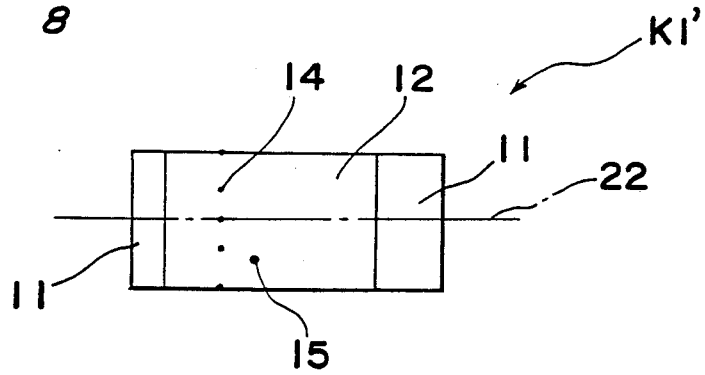
FIGS. 8 and 9 are views similar to FIG. 2, particularly showing modifications thereof, respectively.
Figure 9:
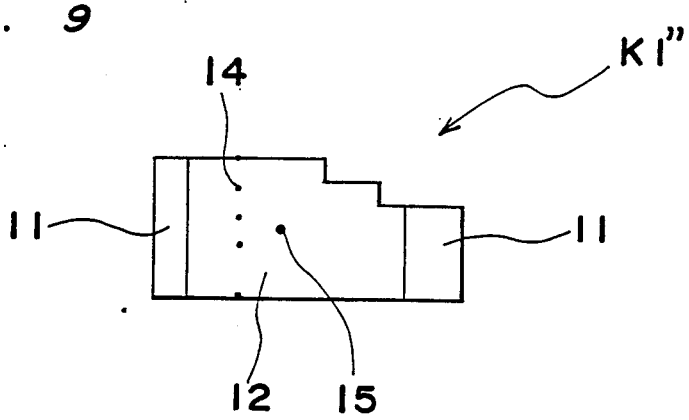

Meanwhile, in the above-described embodiment, the length A of the first conductor portion 12a is set at the quarter wavelength and the length B of the second conductor portion 12b is set smaller than the length A. However, it is also possible to modify the lengths A and B variously. Furthermore, the upper and lower elements 12 and 13 are not necessarily required to be of rectangular shape shown in FIG. 2. For example, recesses can be formed on the upper and lower elements 12 and 13 as shown in FIG. 9. Moreover, the feed point 15 can be deviated from the longitudinal centerline 22 of the dielectric plate 11 as shown in FIG. 8. In addition, it is possible to change impedance characteristic of the antenna K1 by variously changing diameter, number, interval and mounting positions of the reactance posts 14. It is needless to say that by a reciprocity theorem, a small antenna of the present invention used as a transmitting antenna exhibits an impedance characteristic identical with that used as a receiving antenna.

Figure 11:
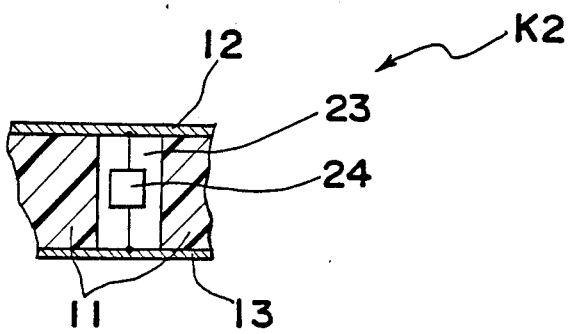
FIGS. 11, 12 and 13 are views similar to FIG. 3, particularly showing second, third and fourth embodiments of the present invention, respectively.
Figure 12:
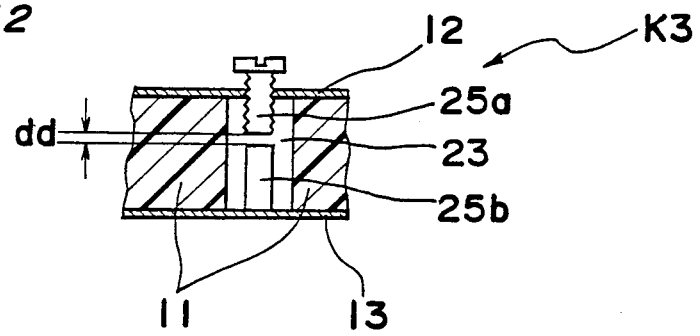
Figure 13:
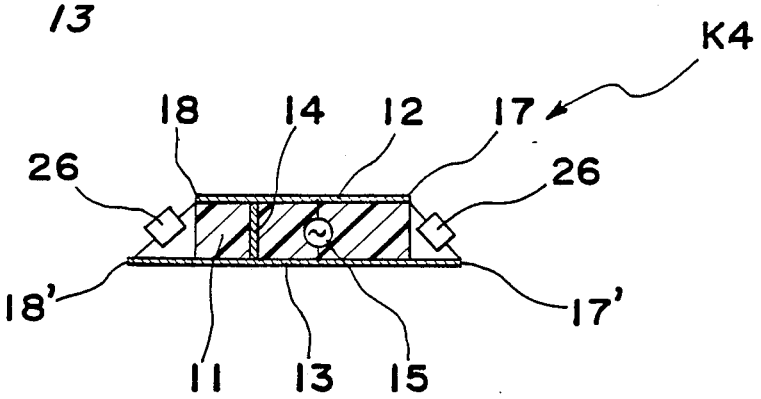

In the above described embodiment, the reactance posts 14 are formed by the conductor wires. However, the reactance posts 14 can be arranged in different manners as shown in FIGS. 11 to 13. Namely, in a small antenna K2 (FIG. 11) according to a second embodiment of the present invention, at least one of a plurality of the reactance posts 14 is replaced by a reactance element 24 formed by a concentrated constant circuit including an inductance element, a capacitance element or the like such that the reactance element 24 is loaded in a cylindrical hollow 23 formed on the dielectric plate 11. By this arrangement of the antenna K2, impedance characteristic of the antenna K2 is variable in a wider range.

Furthermore, in a small antenna K3 (FIG. 12) according to a third embodiment of the present invention, at least one of a plurality of the reactance posts 14 is replaced by a cylinder 25b and a screw 25a which are provided in the hollow 23 of the dielectric plate 11. The cylinder 25b has a flat upper face and the screw 25a is threadedly engaged with the upper element 12 (or the lower element 13) such that a bottom of the screw 25a is spaced a gap dd from the upper face of the cylinder 25b. By increasing or decreasing the gap dd, reactance of the reactance posts 14 can be changed minutely such that impedance of the antenna K3 such as resonant frequency, etc. can be adjusted. Meanwhile, the cylinder 25b and the screw 25a can be replaced by a piston trimmer type variable-capacity element.

Moreover, in a small antenna K4 (FIG. 13) according to a fourth embodiment of the present invention, a reactance element 26 formed by an inductance element, a capacitance element or the like is loaded between one or both of the ends 17 and 18 of the upper element 12 and a corresponding one or ones of the ends 17' and 18' of the lower element 13 so as to change impedance characteristic of the antenna K4.

Figure 14:
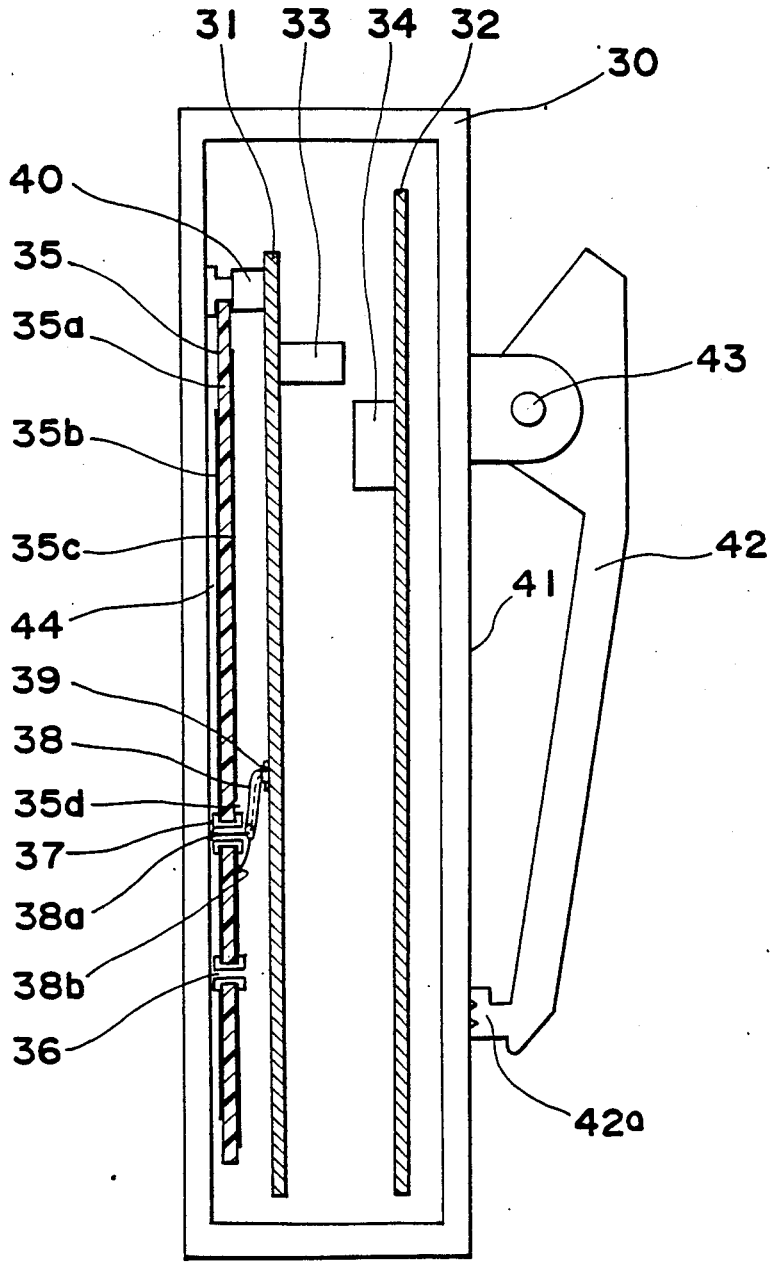
FIG. 14 is a cross-sectional view of one example of the antenna of FIG. 2 applied to a receiver.

Hereinbelow, a selective call receiver, to which the small antenna of the present invention is applied, will be described with reference to FIG. 14. The receiver includes a casing 30 made of electrically insulating material such as plastics, a first printed circuit board 31, a second printed circuit board 32 and a small antenna 35 corresponding to the small antenna K1 of FIGS. 2 and 3. The first and second circuit boards 31 and 32 are accommodated in the casing 30 so as to act as a circuit portion of the receiver. Electronic components 33 and 34 are, respectively, mounted closely on the first and second printed circuit boards 31 and 32 so as to confront each other. Meanwhile, the small antenna 35 is machined from a double-sided printed circuit board so as to be provided with a desired conductor pattern and includes a dielectric plate 35a made of, for example, polytetrafluoroethylene (PTFE), an upper conductive element 35b and a lower conductive element 35c such that the upper and lower conductive elements 35*b* and 35*c* are, respectively, provided on opposite faces of the dielectric plate 11. The antenna 35 includes a connector portion 36 corresponding to the reactance posts 14 of the antenna K1. The connector portion 36 is formed with a through-hole having a small cylindrical conductive face so as to connect the upper and lower conductive elements 35*b* and 35*c* to each other. The antenna 35 is further formed with a through-hole 37 extending between the upper and lower conductive elements 35*b* and 35*c* such that an inner conductor of a coaxial cable 38 extending through the through-hole 37 is connected, at one end portion 38*a* thereof, to the through-hole 37 by soldering, etc. Meanwhile, an outer conductor of the coaxial cable 38 is connected, at one end portion thereof, to an earth point 38*b* of the lower conductive element 35*c* by soldering. The other end portion of the inner conductor of the coaxial cable 38 and the other end portion of the outer conductor of the coaxial cable 38 are connected to a receiving input terminal 39 of the first printed circuit board 31 such that a received power from the antenna 35 is inputted to the receiving input terminal 39. A feed portion corresponding to the feed point 15 of FIGS. 2 and 3 is constituted by the end 38*a* of the inner conductor of the coaxial cable 38 and the earth point 38*b*. It is to be noted here that the feed portion is illustrated rather exaggeratedly in order to clarify its construction. Although not specifically shown, a plurality of holders 40 made of electrically insulating plastics are attached to the first printed circuit board 31. The antenna 35 is inserted into recesses of the holders 40 so as to be held, at a position spaced a predetermined distance from the first printed circuit board 31, in the casing 30. Furthermore, the receiver includes a clip 42 disposed at a rear face 41 of the casing 30. The clip 42 is pivotally provided so as to be pivoted about a rod 43 and is urged towards the rear face 41 by a spring (not shown) such that a distal end 42*a* of the clip 42 is depressed against the rear face 41. It can also be so arranged that the earth point 38*b* is provided on the upper conductive element 35*b*.

By the above described arrangement of the selective call receiver, the small antenna 35 is accommodated in a front portion 44 of the casing 30 and the received power from the antenna 35 is inputted to the feed portion so as to be transmitted to the receiving input terminal 39 through the coaxial cable 38, whereby such functions as reception, discrimination of individual numbers, display, etc. are performed. The casing is attached to a chest pocket, a waist band, etc. of the operator by the clip 42 if necessary. Meanwhile, the through-hole 37 is electrically insulated from the lower conductive element 35*c* by a slit 35*d* formed on the lower conductive element 35*c*.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A small antenna comprising:

a dielectric plate which has parallel upper and lower faces spaced from each other a distance far smaller than a wavelength employed by said small antenna;

an upper conductive plate which is provided on said upper face of said dielectric plate;

a lower conductive plate which is provided on said lower face of said dielectric plate;

a plurality of conductive reactance post members which are, respectively, provided at a plurality of first positions of said dielectric plate so as to extend between said upper and lower conductive plates such that said upper and lower conductive plates are connected, at their positions corresponding to said first positions, to each other by said reactance post members;

said reactance post members dividing said upper and lower conductive plates into a first upper conductive portion and a second upper conductive portion and into a first lower conductive portion and a second lower conductive portion, respectively such that first and second planeparallel plate transmission lines separated from each other by said reactance post members are, respectively, formed by said first upper conductive portion and said first lower conductive portion and by said second upper conductive portion and said second lower conductive portion; and a feed point which is provided at a second position of said dielectric plate for subjecting said upper and lower conductive plates, at their positions corresponding to said second position, to power feed from said feed point.

2. A small antenna as claimed in claim 1, wherein at least one of said upper and lower conductive plates has a rectangular shape.

3. A small antenna as claimed in claim 1, wherein said reactance posts are arranged along a straight line extending at right angles to a longitudinal direction of said upper and lower conductive plates.

4. A small antenna as claimed in claim 1, wherein at least one of said first and second plane-parallel plate transmission lines has a length equal to an odd number multiplied by a quarter of said wavelength.

5. A small antenna as claimed in claim 4, wherein each of said upper and lower conductive plates has a rectangular shape and has a steplike recess.

6. A small antenna as claimed in claim 1, wherein said feed point is offset from a longitudinal centerline of said upper and lower conductive plates.

7. A small antenna as claimed in claim 1, further comprising a reactance element loaded on at least one of said reactance posts.

8. A small antenna as claimed in claim 7, wherein said reactance element has a variable reactance.

9. A small antenna as claimed in claim 1, further comprising a reactance element loaded between one end portion of said upper conductive plate and one end portion of said lower conductive plate.

10. A small antenna as claimed in claim 1, wherein at least one of said reactance post members is a piston type variable condenser.

11. A wireless apparatus comprising a casing, a circuit portion mounted in said casing, and a small antenna, said small antenna comprising:

a double-sided printed circuit board which has opposite conductive faces;

a plurality of conductive reactance post members which are, respectively, provided at a plurality of first positions of said dielectric plate so as to extend between said upper and lower conductive plates such that said upper and lower conductive plates are connected, at their positions corresponding to said first positions, to each other by said reactance post members;

said reactance post members dividing said upper and lower conductive plates into a first upper conductive portion and a second upper conductive portion and into a first lower conductive portion and a second lower conductive portion, respectively such that first and second plane-parallel plate transmission lines separated from each other by said reactance post members are, respectively, formed by said first upper conductive portion and said first lower conductive portion and by said second upper conductive portion and said second lower conductive portion;

a feed point which is provided at a second position of said dielectric plate for subjecting said upper and lower conductive plates, at their positions corresponding to said second position, to power feed from said feed point;

said small antenna being mounted in said casing of said wireless apparatus; and a feeder connected between said feed point and said circuit portion of said wireless apparatus.

12. A wireless apparatus as claimed in claim 11, in which said small antenna is attached to the inner face of a front wall of said casing, and further comprising a clip for attaching said casing to an operator and mounted on the outer face of a rear wall of said casing.

13. A wireless apparatus as claimed in claim 11, wherein said post members are conductive hollow members.

* * * * *